US012359513B2

(12) United States Patent
Bai

(10) Patent No.: US 12,359,513 B2
(45) Date of Patent: Jul. 15, 2025

(54) HYDRAULIC COLLAPSIBLE ROTARY STAND FOR WIRELINE CORING UNDERGROUND DRILL RIG

(71) Applicant: CHIFENG HAO FENG DRILLING CO., LTD., Chifeng (CN)

(72) Inventor: Ruifeng Bai, Chifeng (CN)

(73) Assignee: CHIFENG HAO FENG DRILLING CO., LTD., Chifeng (CN)

( * ) Notice: Subject to any disclaimer, the term of this patent is extended or adjusted under 35 U.S.C. 154(b) by 26 days.

(21) Appl. No.: 18/398,301

(22) Filed: Dec. 28, 2023

(65) Prior Publication Data

US 2025/0122765 A1 Apr. 17, 2025

(30) Foreign Application Priority Data

Oct. 13, 2023 (CN) ..... 202311334150.1

(51) Int. Cl.
*E21B 15/04* (2006.01)

(52) U.S. Cl.
CPC ..... *E21B 15/045* (2013.01)

(58) Field of Classification Search
CPC ..... E21B 15/045
See application file for complete search history.

(56) References Cited

U.S. PATENT DOCUMENTS

| | | | | |
|---|---|---|---|---|
| 3,576,217 | A * | 4/1971 | Schaedler | B25B 21/00 173/19 |
| 3,870,110 | A * | 3/1975 | Richmond | E21B 19/086 175/103 |
| 4,606,155 | A * | 8/1986 | Bukovitz | E21B 15/04 173/193 |
| 6,604,586 | B2 * | 8/2003 | Tremblay | E21B 15/04 175/203 |
| 2019/0078395 | A1 * | 3/2019 | Tian | E21B 7/022 |

* cited by examiner

*Primary Examiner* — D. Andrews
(74) *Attorney, Agent, or Firm* — Bayramoglu Law Offices LLC

(57) ABSTRACT

A hydraulic collapsible rotary stand for a wireline coring underground drill rig includes two main hydraulic supporting posts, at least one hydraulic post erection cylinder, a collapsible stand base, a horizontal rotating base, and a rotary lifting cylinder, where the rotary lifting cylinder drives the collapsible stand base to move up or down; post mounting rods are hinged at a front side of the collapsible stand base; the post mounting rods are respectively connected to the main hydraulic supporting posts; a main post supporting cross-bar is provided between the main hydraulic supporting posts; through the hydraulic post erection cylinder, the main post supporting cross-bar is supported and the main hydraulic supporting post is pushed to be erected or collapsed; a hydraulic gyration supporting beam is provided between the main hydraulic supporting posts; and the hydraulic gyration supporting beam is connected to a lower sliding plate provided with a drill rig.

20 Claims, 3 Drawing Sheets

HYDRAULIC COLLAPSIBLE ROTARY STAND FOR WIRELINE CORING UNDERGROUND DRILL RIG

CROSS REFERENCE TO THE RELATED APPLICATIONS

This application is based upon and claims priority to Chinese Patent Application No. 202311334150.1, filed on Oct. 13, 2023, the entire contents of which are incorporated herein by reference.

TECHNICAL FIELD

The present disclosure relates to the technical field of drilling equipment, and in particular to a hydraulic collapsible rotary stand for a wireline coring underground drill rig.

BACKGROUND

A traditional wireline coring underground drill rig is moved every 3-5 days to another downhole of a mine. When the wireline coring underground drill rig is supported and fixed in operation, at least six people are required at site to level a ground, cushion an anti-skid wood plate, mount the wireline coring underground drill rig, etc. The traditional wireline coring underground drill rig is mounted as follows: two lead screw posts are first mounted, an upper portion of the lead screw post abuts against a rock roof, an anti-skid wood plate is cushioned, and a lower portion of the lead screw post abuts against the anti-skid wood plate on the ground. A scaffold is constructed. Two people fasten a lead screw, two people hold up the lead screw post, one person stands on the scaffold to cushion the anti-skid wood plate, and one person measures a perpendicularity of the lead screw post. The lead screw posts are mounted according to the above order. After the two lead screw posts are mounted completely, a rotary table of the drill rig is carried by two people and is clamped onto the two lead screw posts. Eight bolts on a pressure plate of the rotary table are mounted by two other people. After the rotary table is mounted completely, a rotary head of the wireline coring underground drill rig is mounted by two people to the rotary table. Behind the lead screw post, two bolts are fastened by one person. Upon completion of the mounting of the two lead screw posts and the rotary head, a chain block is suspended at a top of the lead screw post by one person standing on the scaffold. A sliding frame of the wireline coring underground drill rig is moved by four people to a position below the lead screw post. The hoisting chain block is tied. The sliding frame of the wireline coring underground drill rig is hoisted to the rotary head and fixed by four bolts. A gearbox of a hydraulic motor is hoisted by the chain block, and fixed on the sliding frame of the wireline coring underground drill rig. The hydraulic motor is hoisted, mounted on the gearbox and fixed. The scaffold is removed. The wireline coring underground drill rig is started. After an angle of a drilling anchor rod is adjusted, two bolts of the rotary head are fastened. A host of the wireline coring underground drill rig is connected to a hydraulic pump station through a hydraulic oil pipe. The wireline coring underground drill rig is started for drilling, and the anchor rod at a front end of the wireline coring underground drill rig is fixed. After a hole for the anchor rod is drilled, the anchor rod is connected to the wireline coring underground drill rig, and a connecting bolt is mounted. After the two bolts of the rotary head are loosened, the wireline coring underground drill rig is adjusted by four people to a borehole coring angle, and fixed. A lead screw auxiliary post is mounted for core drilling. In order to mount the wireline coring underground drill rig and drill the hole for the anchor rod, at least six people and more than ten hours are required to support the drill rig. This is laborious, with a safety risk.

When the drill rig is moved subsequently, there is a need to reconstruct the scaffold, and dismount the drill rig step by step. For the sake of a construction safety in this process, at least six people are required to assist dismounting of the drill rig. Upon completion of the dismounting, the drill rig is loaded to a truck, moved to a next working area, and unloaded from the truck. Meanwhile, the above mounting, drilling, and dismounting processes are repeated. Hence, for a roadway in which a plurality of horizontal scallop holes are to be drilled, the whole drill rig needs to be dismounted and mounted repeatedly. This construction process is complex and tedious, with a high time cost, a high labor cost and a poor safety.

It is obvious that the traditional wireline coring underground drill rig is inconvenient and defective in operation, and is to be further improved urgently. Therefore, it is desired to provide a supporting device with a simple operation, a low cost and a high safety for the wireline coring underground drill rig.

SUMMARY

A technical problem to be solved by the present disclosure is to provide a hydraulic collapsible rotary stand for a wireline coring underground drill rig, to solve problems of a complex and tedious operation procedure, a high construction cost and a poor safety of the existing wireline coring underground drill rig, and overcome shortages of the prior art.

To solve the above technical problems, the present disclosure provides a hydraulic collapsible rotary stand for a wireline coring underground drill rig, including two main hydraulic supporting posts, at least one hydraulic post erection cylinder, a collapsible stand base, a horizontal rotating base, and a rotary lifting cylinder, where the horizontal rotating base is located under the collapsible stand base; the rotary lifting cylinder is located at a center of the horizontal rotating base; a cylinder body of the rotary lifting cylinder is fixedly connected to the collapsible stand base; the rotary lifting cylinder drives the collapsible stand base to move up or down; and the collapsible stand base is configured to rotate around the center of the horizontal rotating base;

two post mounting rods are hinged at a front side of the collapsible stand base; each of the post mounting rods is connected to one of the main hydraulic supporting posts; a main post supporting cross-bar is provided between lower portions of the two main hydraulic supporting posts; two ends of the main post supporting cross-bar are respectively fixedly connected to the corresponding main hydraulic supporting posts; one end of the hydraulic post erection cylinder is connected to the main post supporting cross-bar, and the other end of the hydraulic post erection cylinder is connected to a rear side of the collapsible stand base; and through the hydraulic post erection cylinder, the main hydraulic supporting post is pushed to be erected or collapsed; and a hydraulic gyration supporting beam is provided between the two main hydraulic supporting posts; the hydraulic gyration supporting beam is connected to a lower sliding plate; and the lower sliding plate is provided with a drill rig.

As an improvement to the present disclosure, the collapsible stand base includes two longitudinal fixed rods and two connecting beams; the two longitudinal fixed rods are parallel to each other; the two connecting beams are respectively located at a front position and a rear position of the longitudinal fixed rods, and two ends of each connecting beam are perpendicularly connected to the longitudinal fixed rods, respectively; and the longitudinal fixed rods and the connecting beams form a rectangular plane frame.

As an improvement to the present disclosure, there are two hydraulic post erection cylinders; one end of each of the two hydraulic post erection cylinders is fixed with the main post supporting cross-bar, and the other end of each of the two hydraulic post erection cylinders is hinged to the connecting beam at the rear side of the collapsible stand base; and through extension or retraction of the hydraulic post erection cylinder, the main hydraulic supporting post is pushed to be erected or collapsed.

As an improvement to the present disclosure, a hydraulic balancing cylinder is further provided on the connecting beam at the rear side of the collapsible stand base; the hydraulic balancing cylinder is located between the two hydraulic post erection cylinders; and the hydraulic balancing cylinder is configured to balance a hydraulic pressure of the two hydraulic post erection cylinders, such that the two hydraulic post erection cylinders are started at the same time and are synchronously raised.

As an improvement to the present disclosure, an end of the hydraulic gyration supporting beam is provided with a hydraulic gyrator; and through rotation of the hydraulic gyrator, the drill rig is driven to rotate up or down at 180 degrees around an axis of the hydraulic gyration supporting beam.

As an improvement to the present disclosure, at least one auxiliary hydraulic supporting post is provided on the collapsible stand base; the auxiliary hydraulic supporting post is detachably connected to the collapsible stand base; the auxiliary hydraulic supporting post is connected to an auxiliary post supporting cross-bar; the auxiliary post supporting cross-bar is connected to a rear portion of the drill rig; and the auxiliary post supporting cross-bar connected to the auxiliary hydraulic supporting post keeps a drilling angle of the drill rig.

As an improvement to the present disclosure, post brackets and a drill rig bracket are provided on the collapsible stand base; two post brackets are respectively located at two sides of the collapsible stand base; an arc-shaped mounting groove is formed in a top of the post bracket; the arc mounting groove is configured to support the main hydraulic supporting post in collapse; the drill rig bracket is located between the two post brackets; the drill rig bracket is a gate-shaped structure; and the drill rig bracket is configured to support a rear portion of the drill rig in the collapse.

As an improvement to the present disclosure, each of the main hydraulic supporting post and the auxiliary hydraulic supporting post is provided with a hydraulic lock; and the hydraulic lock is configured to still keep a supporting height of the corresponding hydraulic supporting post unchanged in response to a certain load on the corresponding hydraulic supporting post.

As an improvement to the present disclosure, the rear side of the collapsible stand base is provided with a multi-angle collapsible hydraulic operating table; the multi-angle collapsible hydraulic operating table is supported by a supporting air spring; the supporting air spring is connected to an air spring switch; device operations are controlled through the multi-angle collapsible hydraulic operating table; and through the air spring switch and the supporting air spring, a height of the multi-angle collapsible hydraulic operating table is adjusted.

As an improvement to the present disclosure, each of two sides of the lower sliding plate is provided with a clamping groove; the clamping groove is connected to a bottom side edge of the drill rig; and the bottom side edge of the drill rig is clamped by the clamping groove to fix the drill rig and the lower sliding plate.

With such a design, the present disclosure has at least the following advantages:

1. The hydraulic collapsible rotary stand for a wireline coring underground drill rig completely uses hydraulic operation. Through mutual cooperation between the hydraulic post erection cylinder and the main hydraulic supporting post, the wireline coring underground drill rig can be quickly erected within a short time, thereby completing the support operation for the wireline coring underground drill rig. Without an assistance of many people in operation, and without construction of a scaffold for supporting and dismounting the drill rig, the present disclosure greatly reduces a number of constructors, achieves a lower construction cost, and lowers a construction hazard to some extent.

2. When the hydraulic collapsible rotary stand for a wireline coring underground drill rig is mounted and dismounted, there is no need to tediously break down the structure. Upon completion of the operation, the main hydraulic supporting post is collapsed by only controlling the hydraulic post erection cylinder. Therefore, the whole wireline coring underground drill rig has a smaller size and is carried conveniently. When the wireline coring underground drill rig is hoisted to a next working area, both time and labor are saved, and a dangerous mounting accident at site is reduced.

3. In response to drilling to a scallop hole, the hydraulic collapsible rotary stand for a wireline coring underground drill rig is unnecessarily moved by many people. The rotary lifting cylinder can be controlled by only one person to raise the collapsible stand base, thus changing a drilling angle. This makes construction less difficult.

4. In the hydraulic collapsible rotary stand for a wireline coring underground drill rig, two main hydraulic supporting posts are used to support the drill rig. Meanwhile, a height of the main hydraulic supporting post can be controlled hydraulically to adapt for roadways with different heights.

5. In the hydraulic collapsible rotary stand for a wireline coring underground drill rig, the main hydraulic supporting posts and the collapsible stand base are obliquely supported by the hydraulic post erection cylinder. This can further improve a support strength of the main hydraulic supporting posts. The hydraulic collapsible rotary stand for a wireline coring underground drill rig is further suitable for ground drilling construction. This expands construction applications.

6. The hydraulic collapsible rotary stand for a wireline coring underground drill rig can be operated simply, reduces a manual labor and mounting time, achieves a higher drilling efficiency of the drill rig, and increases an economic benefit for the worker and the mine.

BRIEF DESCRIPTION OF THE DRAWINGS

The above is only an overview of the technical solutions of the present disclosure. In order to understand the technical means of the present disclosure more clearly, the present disclosure will be further described in detail below with reference to the accompanying drawings and specific embodiments.

In the figures.

Figure 1:
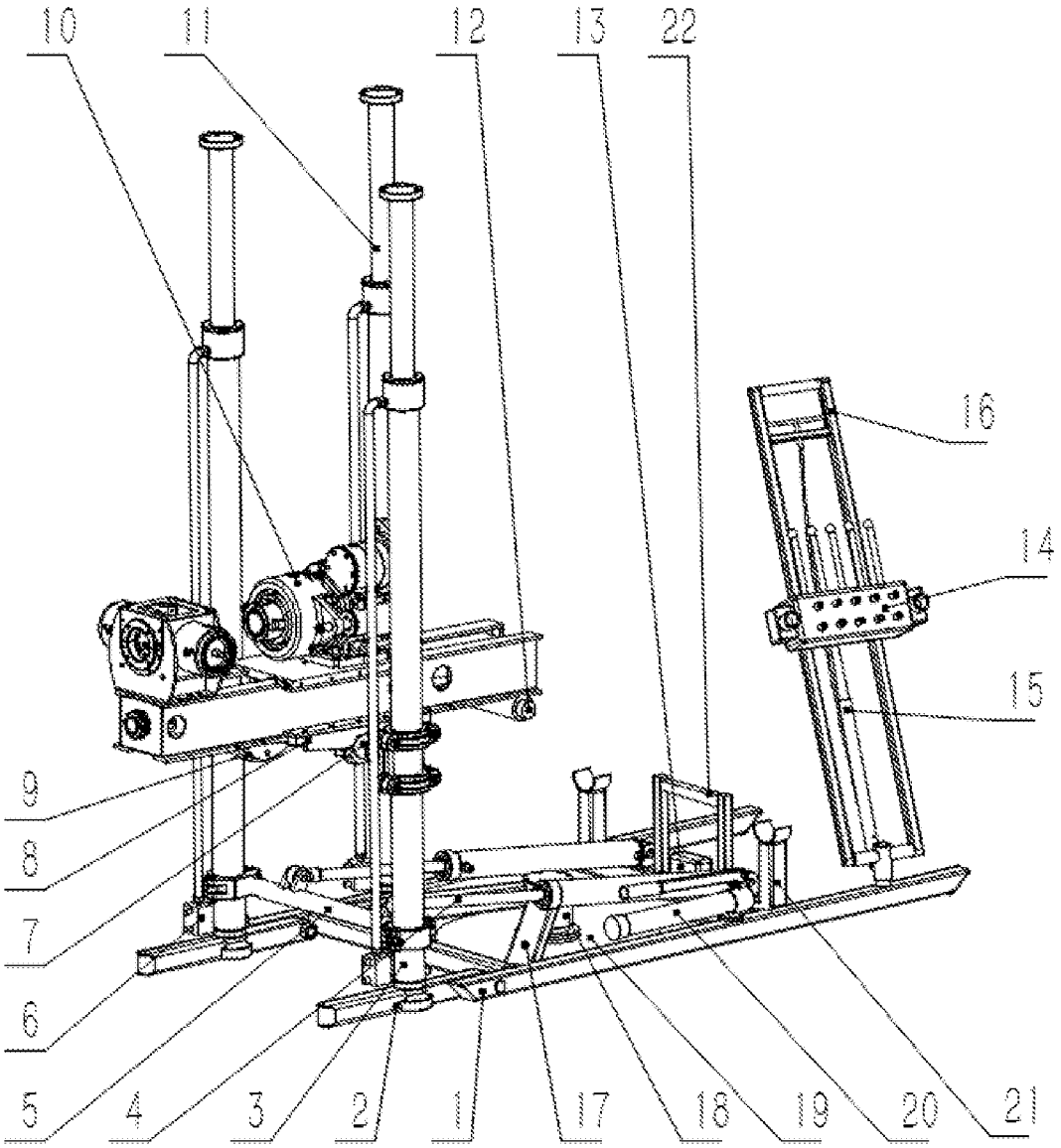
FIG. 1 is an overall schematic structural view of a hydraulic collapsible rotary stand for a wireline coring underground drill rig according to an embodiment of the present disclosure.

1—collapsible stand base, 2—post mounting rod, 3—main hydraulic supporting post, 4—hydraulic post erection cylinder, 5—main post supporting cross—bar, 6—hydraulic lock, 7—hydraulic gyration supporting beam, 8—lower sliding plate, 9—hydraulic gyrator, 10—drill rig, 11—auxiliary hydraulic supporting post, 12—auxiliary post supporting cross—bar, 13—hydraulic balancing cylinder, 14—multi—angle collapsible hydraulic operating table, 15—supporting air spring, 16—air spring switch, 17—rotary lifting cylinder bracket, 18—rotary lifting cylinder, 19—horizontal rotating base, 20—manual hydraulic pump, 21—post bracket, and 22—drill rig bracket.

DETAILED DESCRIPTION OF THE EMBODIMENTS

Examples of the embodiments of the present disclosure are shown in the accompanying drawings. The same or similar reference numerals represent the same or similar components or components having the same or similar functions throughout. The embodiments described below with reference to the accompanying drawings are exemplary. These embodiments are merely used to explain the present disclosure, and should not be construed as a limitation to the present disclosure.

In the description of the utility model, it should be noted that, unless otherwise clearly specified, meanings of terms "mount", "connected", and "connect" should be understood in a board sense. For example, the term may be a fixed connection, a removable connection, or an integral connection; may be a mechanical connection or an electrical connection; and may be a direct connection, an indirect connection by using an intermediate medium, or internal communication between two components. Those of ordinary skill in the art may understand specific meanings of the foregoing terms in the present disclosure based on a specific situation.

Figure 2:
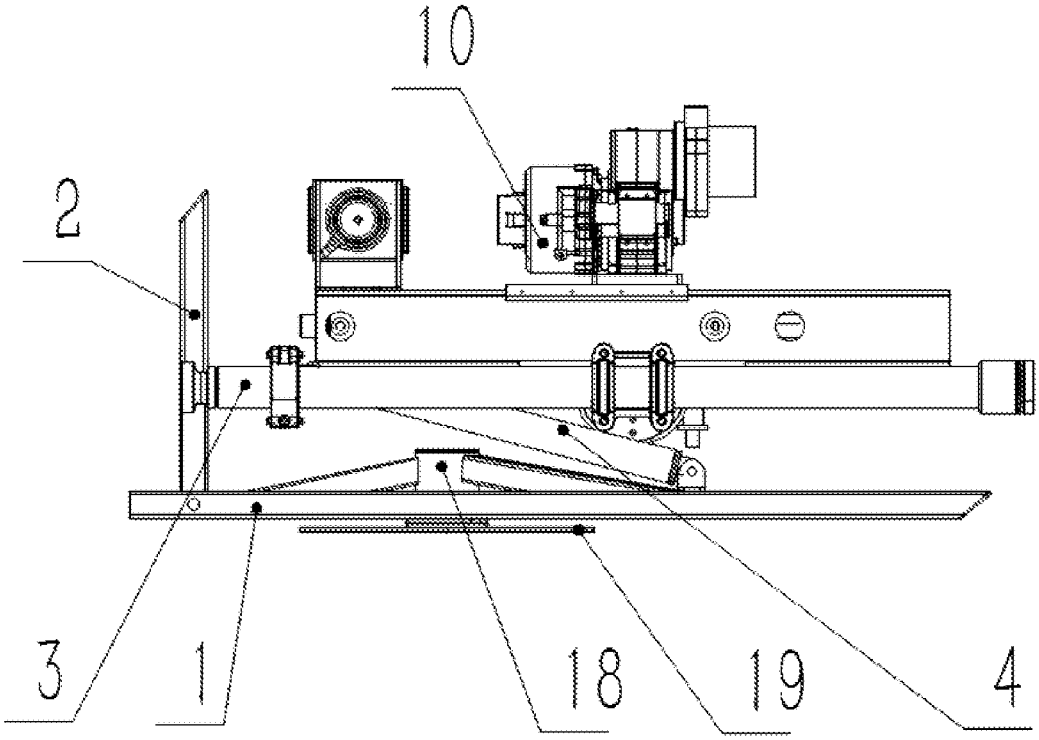
FIG. 2 is a schematic side view of a hydraulic collapsible rotary stand for a wireline coring underground drill rig in a collapsed state according to an embodiment of the present disclosure.
Figure 3:
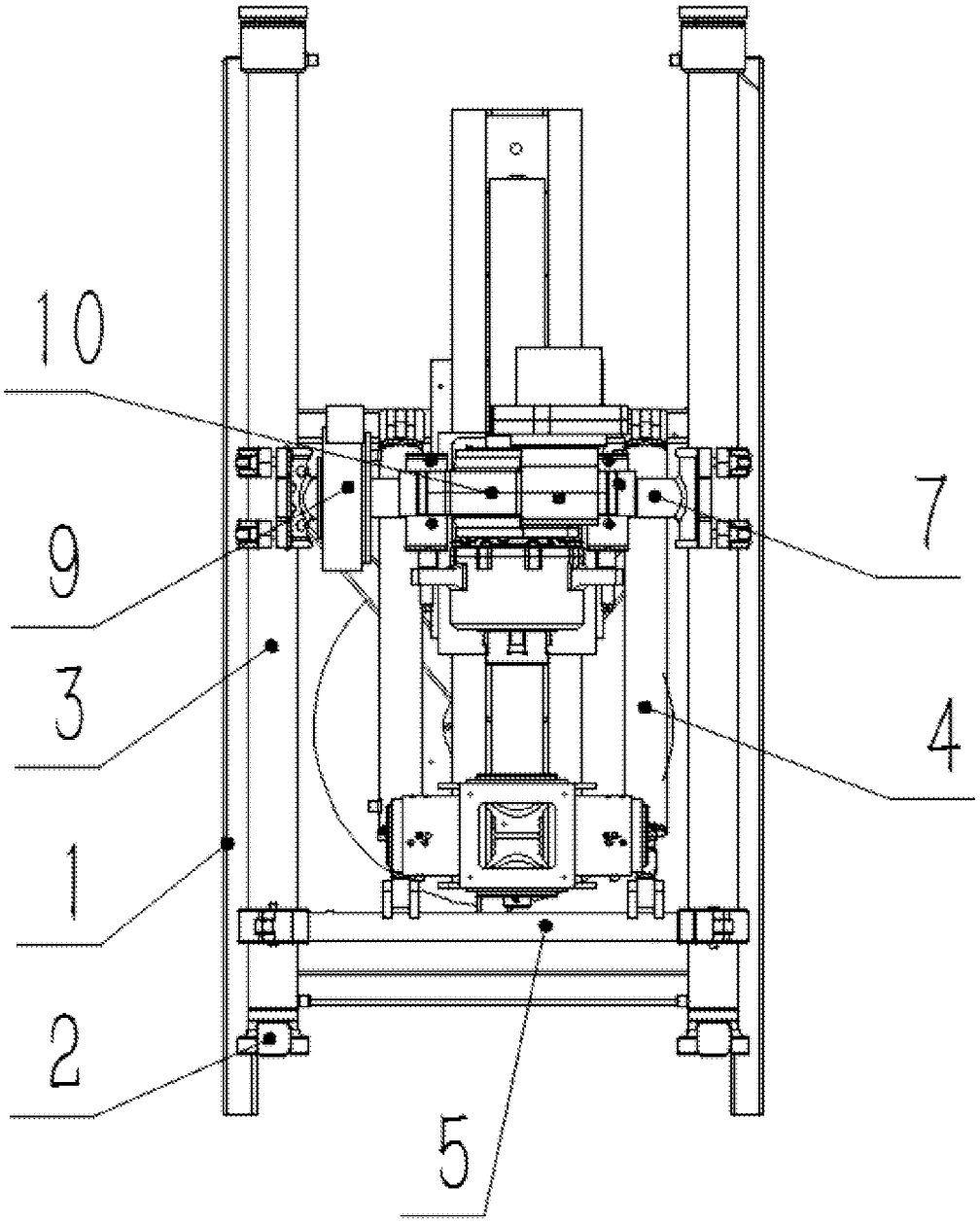
FIG. 3 is a schematic top view of a hydraulic collapsible rotary stand for a wireline coring underground drill rig in a collapsed state according to an embodiment of the present disclosure.

As shown in FIGS. 1-3, the embodiment specifically provides a hydraulic collapsible rotary stand for a wireline coring underground drill rig, including two main hydraulic supporting posts 3, at least one hydraulic post erection cylinder 4, collapsible stand base 1, horizontal rotating base 19, and rotary lifting cylinder 18.

Specifically, in the embodiment, the horizontal rotating base 19 is located under the collapsible stand base 1. The rotary lifting cylinder 18 is located at a center of the horizontal rotating base 19. A cylinder body of the rotary lifting cylinder 18 is fixedly connected to the collapsible stand base 1. The rotary lifting cylinder 18 drives the collapsible stand base 1 to move up or down. The collapsible stand base 1 is configured to rotate around the center of the horizontal rotating base 19. More specifically, a side of the rotary lifting cylinder 18 is connected to rotary lifting cylinder bracket 17 in the embodiment. As shown in FIG. 1, in the embodiment, the rotary lifting cylinder bracket 17 includes four connection supporting rods. The four connection supporting rods are respectively connected to four corners of the collapsible stand base 1, such that the collapsible stand base 1 is fixed with the rotary lifting cylinder 18. Through extension and retraction of the rotary lifting cylinder 18, the collapsible stand base 1 can be pushed to move up or down. Moreover, while the cylinder body of the rotary lifting cylinder 18 can rotate circumferentially relative to a telescopic rod, the collapsible stand base 1 and the horizontal rotating base 19 can also rotate circumferentially. Therefore, a drilling angle of the hydraulic collapsible rotary stand for a wireline coring underground drill rig in a horizontal direction can be adjusted. Meanwhile, in the embodiment, a side of the collapsible stand base 1 is provided with manual hydraulic pump 20. The manual hydraulic pump 20 can manually provide a hydraulic pressure for the rotary lifting cylinder 18, such that the rotary lifting cylinder moves up or down. Certainly, except for the manual method, the control method of the rotary lifting cylinder can also be integrated with other hydraulic control methods, and an automatic control method is used for operation in the embodiment.

Further, in the embodiment, the collapsible stand base 1 includes two longitudinal fixed rods and two connecting beams. The two longitudinal fixed rods are parallel to each other. The two connecting beams are respectively located at a front position and a rear position of the longitudinal fixed rods, and two ends of each connecting beam are perpendicularly connected to the longitudinal fixed rods, respectively. The longitudinal fixed rods and the connecting beams form a rectangular plane frame. Two post mounting rods 2 are hinged at a front side of the collapsible stand base 1. Each of the post mounting rods 2 is connected to one of the main hydraulic supporting posts 3. Main post supporting cross-bar 5 is provided between lower portions of the two main hydraulic supporting posts 3. Two ends of the main post supporting cross-bar 5 are respectively fixedly connected to the corresponding main hydraulic supporting posts 3. There is at least one hydraulic post erection cylinder 4 in the embodiment. Preferably, two hydraulic post erection cylinders are provided. One end of the hydraulic post erection cylinder 4 is connected to the main post supporting cross-bar 5, and the other end of the hydraulic post erection cylinder 4 is connected to a rear side of the collapsible stand base 1 and preferably hinged to the connecting beam at the rear side of the collapsible stand base 1. Through extension or retraction of the hydraulic post erection cylinder 4, the main hydraulic supporting post 3 is pushed to be erected or collapsed. The collapsed hydraulic collapsible rotary stand for a wireline coring underground drill rig has a smaller transportation space, and is more convenient for movement and transportation.

Still further, in the embodiment, hydraulic balancing cylinder 13 is further provided on the connecting beam at the rear side of the collapsible stand base 1. The hydraulic balancing cylinder 13 is located between the two hydraulic post erection cylinders 4. The hydraulic balancing cylinder 13 is configured to balance a hydraulic pressure of the two hydraulic post erection cylinders 4, such that the two hydraulic post erection cylinders 4 are started at the same time and are synchronously raised. It is to be noted that the hydraulic balancing cylinder 13 between the two hydraulic post erection cylinders 4 is mainly intended to balance a hydraulic acting force of the two hydraulic post erection cylinders 4, such that the two hydraulic post erection cylinders 4 have a synchronous telescopic amount, and thus the main hydraulic supporting posts 3 are stressed uniformly and erected. This prevents distortion and deformation of the two hydraulic post erection cylinders 4 due to desynchronization.

In addition, in the embodiment, hydraulic gyration supporting beam 7 is provided between the two main hydraulic supporting posts 3. The hydraulic gyration supporting beam 7 is connected to lower sliding plate 8. More specifically, each of two sides of the lower sliding plate 8 is provided with a clamping groove. The clamping groove is connected to a bottom side edge of drill rig 10. The bottom side edge of the drill rig 10 is clamped by the clamping groove to fix the drill rig 10 and the lower sliding plate 8. In the embodiment, by loosening the clamping groove of the lower sliding plate 8, the hydraulic collapsible rotary stand for a wireline coring underground drill rig can move back and forth, thereby adjusting a space from a front end of the wireline coring underground drill rig to a rock wall to facilitate drilling operation. Further, an end of the hydraulic gyration supporting beam 7 is provided with hydraulic gyrator 9. By controlling rotation of the hydraulic gyrator 9 in the drilling operation, the drill rig 10 is driven to rotate up or down at 180 degrees around an axis of the hydraulic gyration supporting beam 7. By synchronously combining with 360-degree rotation of the rotary lifting cylinder 18 in the embodiment, the drilling operation at any position in a certain space can be realized.

Further, for the sake of a higher stability of the drill rig 10 in the drilling process in the embodiment, at least one auxiliary hydraulic supporting post 11 is further provided on the collapsible stand base 1. The auxiliary hydraulic supporting post 11 is detachably connected to the collapsible stand base 1. When the device is collapsed, the auxiliary hydraulic supporting post 11 can be detached. When the device is supported, the auxiliary hydraulic supporting post 11 is mounted on the collapsible stand base 1 again. Still further, in the embodiment, the auxiliary hydraulic supporting post 11 is connected to auxiliary post supporting cross-bar 12. The auxiliary post supporting cross-bar 12 is connected to a rear portion of the drill rig 10. The auxiliary post supporting cross-bar 12 can support the rear portion of the drill rig 10, thereby keeping a drilling angle of the drill rig 10.

It is to be noted that each of the main hydraulic supporting post 3 and the auxiliary hydraulic supporting post 11 is provided with hydraulic lock 6 in the embodiment. The hydraulic lock 6 is configured to still keep a supporting height of the corresponding hydraulic supporting post unchanged in response to a certain load on the corresponding hydraulic supporting post. A specific structure and a connection structure of the hydraulic lock 6 use an existing hydraulic structure, and can be adaptively adjusted with a change of the whole structure. This is not detailed herein.

More specifically, post brackets 21 and a drill rig bracket 22 are provided on the collapsible stand base 1 in the embodiment, so as to support the main hydraulic supporting posts 3 and the drill rig 10 respectively when the hydraulic collapsible rotary stand for a wireline coring underground drill rig is collapsed, thereby preventing deformation and improving a service life of the device. Specifically, two post brackets 21 are respectively located at two sides of the collapsible stand base 1. An arc-shaped mounting groove is formed in a top of the post bracket 21. The arc mounting groove cooperates with a side of the main hydraulic supporting post 3. The drill rig bracket 22 is located between the two post brackets 21. The drill rig bracket 22 is a gate-shaped structure. A top of the drill rig bracket 22 raises and supports the rear portion of the drill rig 10.

In the embodiment, for ease of operation of the device, the rear side of the collapsible stand base 1 is provided with multi-angle collapsible hydraulic operating table 14. Through the multi-angle collapsible hydraulic operating table 14, the main hydraulic supporting post 3, the hydraulic post erection cylinder 4, the collapsible stand base 1, the horizontal rotating base 19, the rotary lifting cylinder 18 and the like in the device can be controlled, thereby supporting the drill rig 10. The multi-angle collapsible hydraulic operating table 14 is supported by supporting air spring 15. The supporting air spring 15 is connected to air spring switch 16. Through the air spring switch 16 and the supporting air spring 15, a height of the multi-angle collapsible hydraulic operating table 14 is adjusted. Still further, in the embodiment, the air spring switch 16 is provided with a metal structure frame. The multi-angle collapsible hydraulic operating table 14 may be mounted on the metal structure frame of the air spring switch 16. A bottom of the metal structure frame is hinged to the collapsible stand base 1. When the device is to be collapsed, only the air spring switch 16 is pulled to remove a supporting force of the supporting air spring 15, and the multi-angle collapsible hydraulic operating table 14 and the metal structure frame can be collapsed. In response to the drilling operation, the metal structure frame is erected and fixed by the supporting air spring 15, such that the multi-angle collapsible hydraulic operating table 14 can be operated conveniently by a constructor.

The above are only preferred embodiments of the present disclosure, and are not intended to limit the present disclosure in any form. Simple alterations, equivalent changes or modifications made by those skilled in the art make using the technical contents disclosed above fall within the scope of protection of the present disclosure.

What is claimed is:

1. A hydraulic collapsible rotary stand for a wireline coring underground drill rig, comprising two main hydraulic supporting posts, at least one hydraulic post erection cylinder, a collapsible stand base, a horizontal rotating base, and a rotary lifting cylinder, wherein the horizontal rotating base is located under the collapsible stand base; the rotary lifting cylinder is located at a center of the horizontal rotating base; a cylinder body of the rotary lifting cylinder is fixedly connected to the collapsible stand base; the rotary lifting cylinder drives the collapsible stand base to move up or down; and the collapsible stand base is configured to rotate around the center of the horizontal rotating base;

two post mounting rods are hinged at a front side of the collapsible stand base; each of the two post mounting rods is connected to one of the two main hydraulic supporting posts; a main post supporting cross-bar is provided between lower portions of the two main hydraulic supporting posts; two ends of the main post supporting cross-bar are respectively fixedly connected to the corresponding main hydraulic supporting posts; a first end of the hydraulic post erection cylinder is connected to the main post supporting cross-bar, and a second end of the hydraulic post erection cylinder is connected to a rear side of the collapsible stand base; and through the hydraulic post erection cylinder, the main hydraulic supporting posts are pushed to be erected or collapsed; and a hydraulic gyration supporting beam is provided between the two main hydraulic supporting posts; the hydraulic gyration supporting beam is connected to a lower sliding plate; and the lower sliding plate is provided with a drill rig.

2. The hydraulic collapsible rotary stand for the wireline coring underground drill rig according to claim 1, wherein the collapsible stand base comprises two longitudinal fixed rods and two connecting beams; the two longitudinal fixed rods are parallel to each other; the two connecting beams are respectively located at a front position and a rear position of the two longitudinal fixed rods, and two ends of each of the two connecting beams are perpendicularly connected to the two longitudinal fixed rods, respectively; and the two longitudinal fixed rods and the two connecting beams form a rectangular plane frame.

3. The hydraulic collapsible rotary stand for the wireline coring underground drill rig according to claim 2, wherein there are two hydraulic post erection cylinders; a first end of each of the two hydraulic post erection cylinders is fixed with the main post supporting cross-bar, and a second end of each of the two hydraulic post erection cylinders is hinged to the connecting beam at the rear side of the collapsible stand base; and through extension or retraction of the hydraulic post erection cylinder, the main hydraulic supporting posts are pushed to be erected or collapsed.

4. The hydraulic collapsible rotary stand for the wireline coring underground drill rig according to claim 3, wherein a hydraulic balancing cylinder is provided on the connecting beam at the rear side of the collapsible stand base; the hydraulic balancing cylinder is located between two hydraulic post erection cylinders; and the hydraulic balancing cylinder is configured to balance a hydraulic pressure of the two hydraulic post erection cylinders, such that the two hydraulic post erection cylinders are started at a same time and are synchronously raised.

5. The hydraulic collapsible rotary stand for the wireline coring underground drill rig according to claim 3, wherein an end of the hydraulic gyration supporting beam is provided with a hydraulic gyrator; and through rotation of the hydraulic gyrator, the drill rig is driven to rotate up or down at 180 degrees around an axis of the hydraulic gyration supporting beam.

6. The hydraulic collapsible rotary stand for the wireline coring underground drill rig according to claim 3, wherein at least one auxiliary hydraulic supporting post is provided on the collapsible stand base; the auxiliary hydraulic supporting post is detachably connected to the collapsible stand base; the auxiliary hydraulic supporting post is connected to an auxiliary post supporting cross-bar; the auxiliary post supporting cross-bar is connected to a rear portion of the drill rig; and the auxiliary post supporting cross-bar connected to the auxiliary hydraulic supporting post keeps a drilling angle of the drill rig.

7. The hydraulic collapsible rotary stand for the wireline coring underground drill rig according to claim 3, wherein two post brackets and a drill rig bracket are provided on the collapsible stand base; two post brackets are respectively located at two sides of the collapsible stand base; an arc-shaped mounting groove is formed in a top of the post bracket; the arc mounting groove is configured to support the main hydraulic supporting post in collapse; the drill rig bracket is located between the two post brackets; the drill rig bracket is a gate-shaped structure; and the drill rig bracket is configured to support a rear portion of the drill rig when collapsed.

8. The hydraulic collapsible rotary stand for the wireline coring underground drill rig according to claim 3, wherein the rear side of the collapsible stand base is provided with a multi-angle collapsible hydraulic operating table; the multi-angle collapsible hydraulic operating table is supported by a supporting air spring; the supporting air spring is connected to an air spring switch; device operations are controlled through the multi-angle collapsible hydraulic operating table; and through the air spring switch and the supporting air spring, a height of the multi-angle collapsible hydraulic operating table is adjusted.

9. The hydraulic collapsible rotary stand for the wireline coring underground drill rig according to claim 2, wherein a hydraulic balancing cylinder is provided on the connecting beam at the rear side of the collapsible stand base; the hydraulic balancing cylinder is located between two hydraulic post erection cylinders; and the hydraulic balancing cylinder is configured to balance a hydraulic pressure of the two hydraulic post erection cylinders, such that the two hydraulic post erection cylinders are started at a same time and are synchronously raised.

10. The hydraulic collapsible rotary stand for the wireline coring underground drill rig according to claim 2, wherein an end of the hydraulic gyration supporting beam is provided with a hydraulic gyrator; and through rotation of the hydraulic gyrator, the drill rig is driven to rotate up or down at 180 degrees around an axis of the hydraulic gyration supporting beam.

11. The hydraulic collapsible rotary stand for the wireline coring underground drill rig according to claim 2, wherein at least one auxiliary hydraulic supporting post is provided on the collapsible stand base; the auxiliary hydraulic supporting post is detachably connected to the collapsible stand base; the auxiliary hydraulic supporting post is connected to an auxiliary post supporting cross-bar; the auxiliary post supporting cross-bar is connected to a rear portion of the drill rig; and the auxiliary post supporting cross-bar connected to the auxiliary hydraulic supporting post keeps a drilling angle of the drill rig.

12. The hydraulic collapsible rotary stand for the wireline coring underground drill rig according to claim 2, wherein two post brackets and a drill rig bracket are provided on the collapsible stand base; two post brackets are respectively located at two sides of the collapsible stand base; an arc-shaped mounting groove is formed in a top of the post bracket; the arc mounting groove is configured to support the main hydraulic supporting post in collapse; the drill rig bracket is located between the two post brackets; the drill rig bracket is a gate-shaped structure; and the drill rig bracket is configured to support a rear portion of the drill rig when collapsed.

13. The hydraulic collapsible rotary stand for the wireline coring underground drill rig according to claim 2, wherein the rear side of the collapsible stand base is provided with a multi-angle collapsible hydraulic operating table; the multi-angle collapsible hydraulic operating table is supported by a supporting air spring; the supporting air spring is connected to an air spring switch; device operations are controlled through the multi-angle collapsible hydraulic operating table; and through the air spring switch and the supporting air spring, a height of the multi-angle collapsible hydraulic operating table is adjusted.

14. The hydraulic collapsible rotary stand for the wireline coring underground drill rig according to claim 1, wherein a hydraulic balancing cylinder is provided on the connecting beam at the rear side of the collapsible stand base; the hydraulic balancing cylinder is located between two hydraulic post erection cylinders; and the hydraulic balancing cylinder is configured to balance a hydraulic pressure of the two hydraulic post erection cylinders, such that the two hydraulic post erection cylinders are started at a same time and are synchronously raised.

15. The hydraulic collapsible rotary stand for the wireline coring underground drill rig according to claim 1, wherein an end of the hydraulic gyration supporting beam is provided with a hydraulic gyrator; and through rotation of the hydraulic gyrator, the drill rig is driven to rotate up or down at 180 degrees around an axis of the hydraulic gyration supporting beam.

16. The hydraulic collapsible rotary stand for the wireline coring underground drill rig according to claim 1, wherein at least one auxiliary hydraulic supporting post is provided on the collapsible stand base; the auxiliary hydraulic supporting post is detachably connected to the collapsible stand base; the auxiliary hydraulic supporting post is connected to an auxiliary post supporting cross-bar; the auxiliary post supporting cross-bar is connected to a rear portion of the drill rig; and the auxiliary post supporting cross-bar connected to the auxiliary hydraulic supporting post keeps a drilling angle of the drill rig.

17. The hydraulic collapsible rotary stand for the wireline coring underground drill rig according to claim 16, wherein each of the main hydraulic supporting post and the auxiliary hydraulic supporting post is provided with a hydraulic lock; and the hydraulic lock is configured to still keep a supporting height of the corresponding hydraulic supporting post unchanged in response to a certain load on the corresponding hydraulic supporting post.

18. The hydraulic collapsible rotary stand for the wireline coring underground drill rig according to claim 1, wherein two post brackets and a drill rig bracket are provided on the collapsible stand base; two post brackets are respectively located at two sides of the collapsible stand base; an arc-shaped mounting groove is formed in a top of the post bracket; the arc mounting groove is configured to support the main hydraulic supporting post in collapse; the drill rig bracket is located between the two post brackets; the drill rig bracket is a gate-shaped structure; and the drill rig bracket is configured to support a rear portion of the drill rig when collapsed.

19. The hydraulic collapsible rotary stand for the wireline coring underground drill rig according to claim 1, wherein the rear side of the collapsible stand base is provided with a multi-angle collapsible hydraulic operating table; the multi-angle collapsible hydraulic operating table is supported by a supporting air spring; the supporting air spring is connected to an air spring switch; device operations are controlled through the multi-angle collapsible hydraulic operating table; and through the air spring switch and the supporting air spring, a height of the multi-angle collapsible hydraulic operating table is adjusted.

20. The hydraulic collapsible rotary stand for the wireline coring underground drill rig according to claim 1, wherein each of two sides of the lower sliding plate is provided with a clamping groove; the clamping groove is connected to a bottom side edge of the drill rig; and the bottom side edge of the drill rig is clamped by the clamping groove to fix the drill rig and the lower sliding plate.

* * * * *